US005327113A

United States Patent [19]

Voetsch

[11] Patent Number: 5,327,113

[45] Date of Patent: Jul. 5, 1994

[54] TRANSFORMER WITH COIL COMPRESSION

[75] Inventor: Guenther Voetsch, Weiz, Austria

[73] Assignee: Elin Energieversorgung GmbH, Vienna, Austria

[21] Appl. No.: 949,639

[22] PCT Filed: Jun. 7, 1991

[86] PCT No.: PCT/AT91/00068

§ 371 Date: Dec. 23, 1992

§ 102(e) Date: Dec. 23, 1992

[87] PCT Pub. No.: WO91/19304

PCT Pub. Date: Dec. 12, 1991

[30] Foreign Application Priority Data

Jun. 8, 1990 [AT] Austria ..... 1253/90

[51] Int. Cl.[5] ..... H01F 27/30

[52] U.S. Cl. ..... 336/197; 29/602.1

[58] Field of Search ..... 336/197, 210, 92; 29/602.1, 606; 310/214

[56] References Cited

U.S. PATENT DOCUMENTS

| | | | |
|---|---|---|---|
| 1,961,761 | 6/1934 | Hendricks, Jr. | 336/197 |
| 3,156,885 | 11/1964 | Koza | 336/197 |
| 3,172,064 | 3/1965 | Schmid et al. | 336/197 |
| 3,772,627 | 11/1973 | Wilk et al. | 336/197 |
| 4,009,461 | 2/1977 | Usry | 336/197 |
| 4,464,644 | 8/1984 | Fukatsu | 336/90 |
| 4,631,509 | 12/1986 | Arii | 336/92 |
| 4,754,250 | 6/1988 | Duin | 336/65 |

FOREIGN PATENT DOCUMENTS

| | | | |
|---|---|---|---|
| 328552 | 3/1976 | Austria . | |
| 1488186 | 3/1969 | Fed. Rep. of Germany . | |
| 1513977 | 7/1969 | Fed. Rep. of Germany | 336/197 |
| 2236212 | 2/1974 | Fed. Rep. of Germany . | |
| 2260399 | 6/1974 | Fed. Rep. of Germany . | |
| 3340985 | 5/1985 | Fed. Rep. of Germany . | |
| 351667 | 3/1961 | Switzerland | 336/197 |

*Primary Examiner*—Thomas J. Kozma

*Attorney, Agent, or Firm*—Sandler, Greenblum & Bernstein

[57] ABSTRACT

A substation transformer is disclosed which includes a winding, a winding compression ring, which closes off the winding, a compression beam, and expanding spring elements. The expanding spring elements are disposed concentrically around a core portion of the winding, and are placed between the compression beam and the winding compression ring. Each of the spring elements includes a spring, a bushing receiving a spring, and a compression piston which has been provided to close an open end of the bushing. The compression piston is adapted to limit movement of the spring. A post-installation modification mechanism is provided which includes a compression mechanism for compressing the winding. The compression mechanism comprises hydraulic cylinders adapted to be removably inserted between the compression beam and the winding compression ring. Adjustment screws are provided within a threaded bore in a support surface of the compression beam, and allow adjustment of the pressure on the compression piston to thereby adjust the compression of disk springs. A stop is removably provided in the bushing to limit movement of the compression piston to thereby hold the disk springs in a pre-stressed state.

7 Claims, 2 Drawing Sheets

TRANSFORMER WITH COIL COMPRESSION

Figure 1:
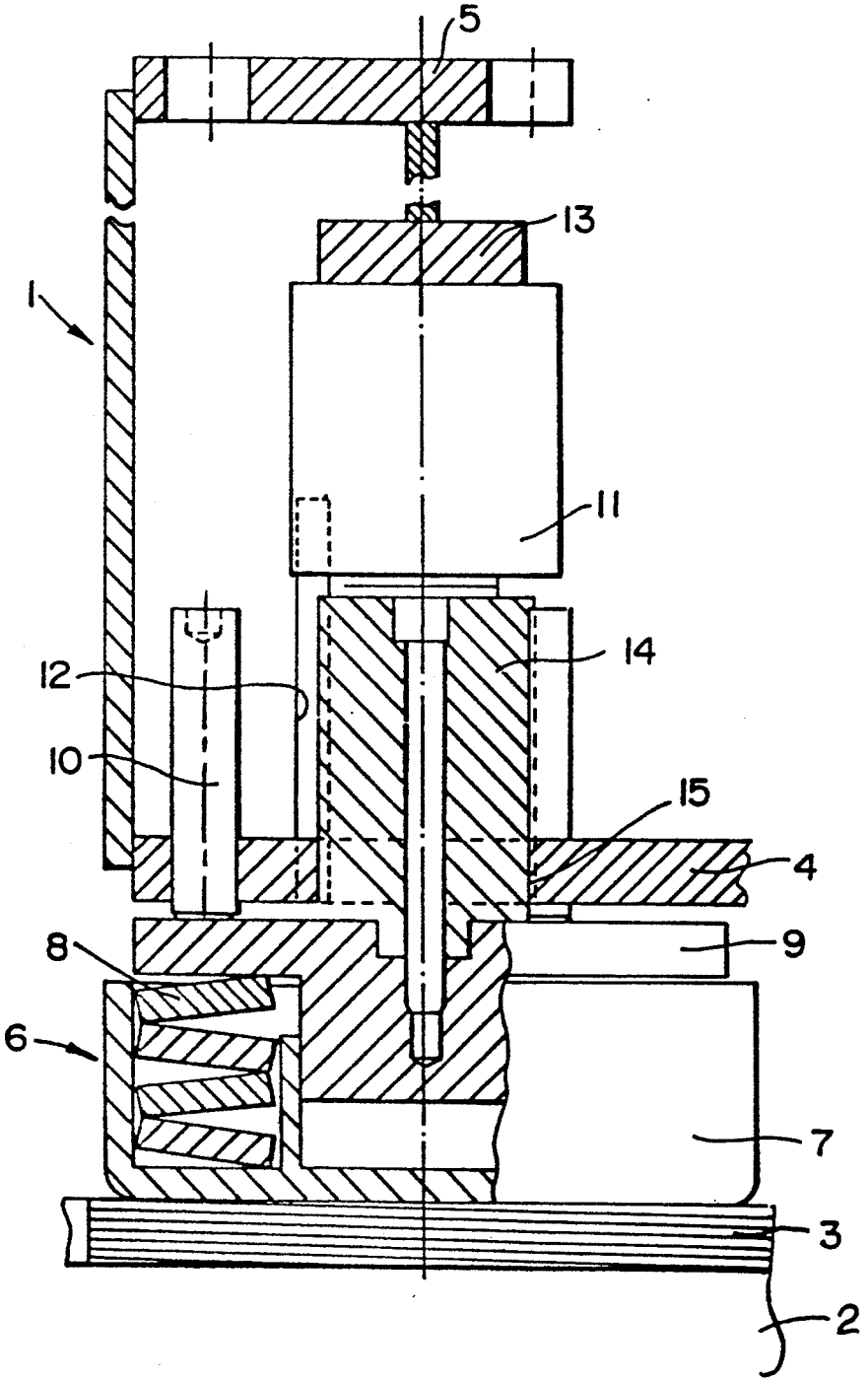

The invention relates to a transformer, in particular a substation transformer, having a compression beam and a winding compression ring closing off the winding, where expanding spring elements disposed concentrically around the winding core are disposed between the compression beam and the winding compression ring, where the compression beam has a support surface extending horizontally in respect to its axis of symmetry which is provided with a bore on the side facing the winding compression ring and has a further support surface or a shoulder on its upper end, and where each spring element consists of a bushing which receives the spring and is closed off with a compression piston which limits the spring path.

The windings of transformers are greatly stressed mechanically during operation, particularly when short-circuits appear. A loosening of the coils can occur because of dynamic short-circuit forces, which inevitably results in the destruction of the transformer.

This fact is already taken into consideration during calculation, design and construction. Besides technical and technological steps during production, the windings are subjected to large pre-compression loads by the producer of the transformer.

The support of the winding is customarily provided by means of rigid elements, such as layered wood pieces or the like, disposed between the compression beam and the winding compression ring.

These measures are not sufficient in the case of transformers which are particularly stressed by frequent short-circuits, such as transformers in the catenary network of railroad companies, so-called substation transformers.

A winding compression for transformers and inductance coils having an expanding spring of the previously mentioned type is known from U.S. Pat. No. 3,772,627.

Furthermore, a transformer is known from DE-OS 22 60 399 where disk springs are employed in its compression construction. The The retroactive compression of the windings of transformers which do not have such known spring elements is extremely costly.

It is therefore the object of the invention to produce a transformer of the previously described type where a retroactive winding compression is possible and where therefore loosening of the winding by dynamic short-circuit forces is prevented.

The transformer in accordance with the invention is distinguished in that for the post-installation of the spring elements provided with disk springs the winding can be precompressed by means of hydraulic cylinders which can be inserted between the compression beam and the winding compression ring and that the bore has a support ring or a threaded bore for adjustment screws, where the adjustment screws act on the compression piston of the insertable pre-stressed spring elements and the bushing of the spring elements has a stop for the compression piston holding the pre-stressed disk springs, which can also be removed after removal of the hydraulic cylinders.

With this invention it is possible for the first time to perform post-installation as well as simple regulation of the tension. In addition, controlled compression is possible by means of the invention. A defined compression can also be provided in the course of inspection.

During post-installation of the invention the spring assembly is pre-stressed and inserted while being pre-stressed. It is therefore possible to attain the pre-defined compression on the winding by means of the adjustment screws.

If the hydraulic cylinder is to be installed at the same time, it is then possible, for example by means of a connection to the outside, to regulate the tension at any time. The winding compression required for the operational reliability of the transformer must be maintained over the remainder of service life of the transformer.

In accordance with a further particular characteristic of the invention at least one adjusting screw seated in the compression beam is provided, which acts on the compression piston. By means of this the possible compression regulation of the winding becomes possible without the installation or removal of the respective parts.

In accordance with a particular characteristic of the invention, at least one guide bolt extending vertically upward is disposed on the support surface. Because of this it is possible to position the hydraulic cylinder necessary for installation in the best way.

The invention will be described in detail by means of exemplary embodiments illustrated in the drawings.

Figure 2:
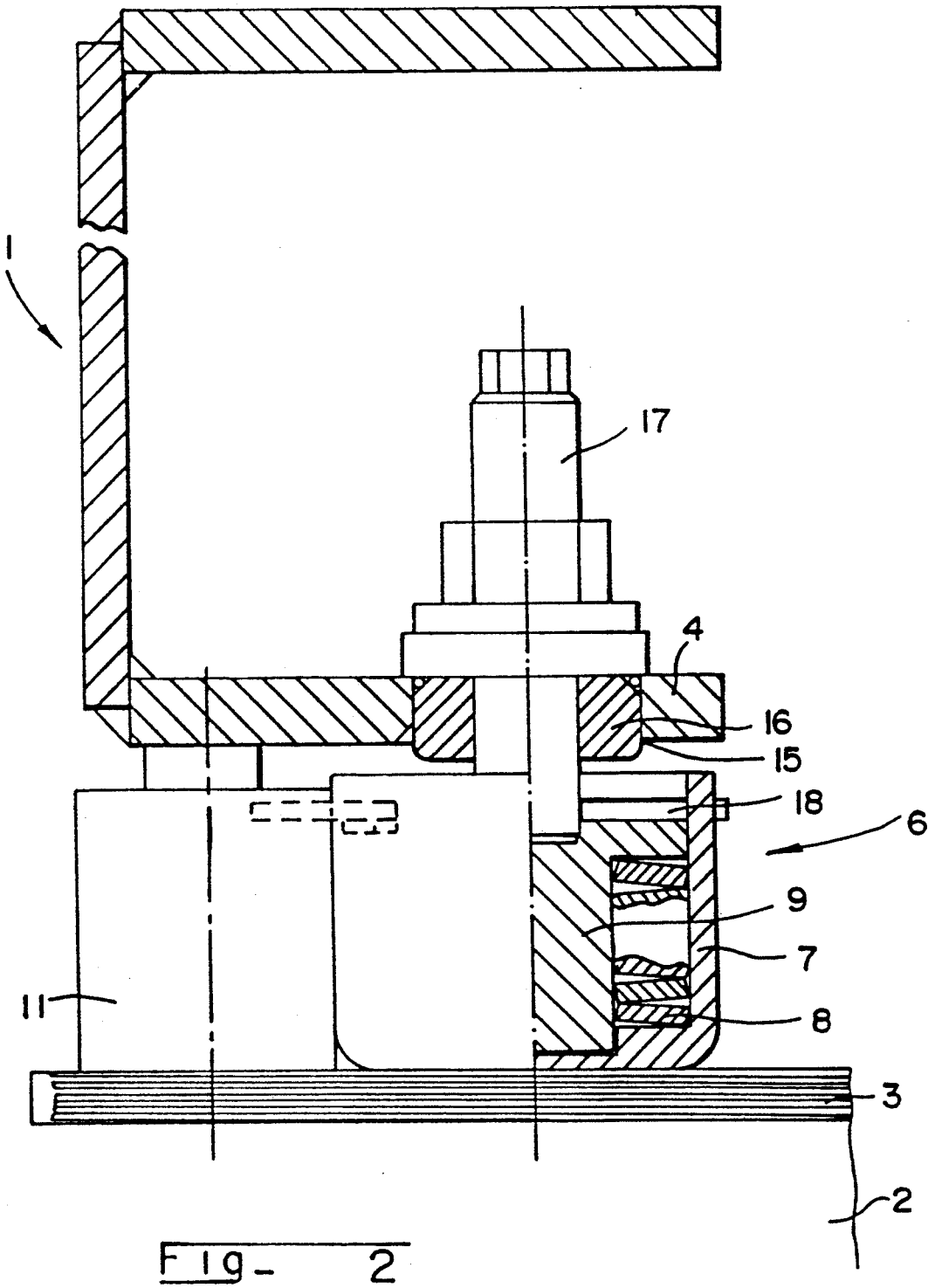

FIG. 1 shows the spring element and its installation in a mass-produced transformer, and FIG. 2 shows the spring element and its installation when retrofitting the transformer.

In accordance with FIG. 1, the transformer has a compression beam 1, which extends in the shape of a yoke over the windings 2, which are closed off by the winding compression ring 3. This compression beam 1, which is only partially shown, has two support surfaces 4, 5, which are disposed horizontally in respect to a plane of symmetry, so that a C-shaped partial section results. The expanding spring element 6 is disposed between the compression beam 1 and winding ring 3. The spring element 6 consists of a bushing 7, the spring, particularly disk springs 8 arranged on top of each other, and the compression piston 9. The adjustment screws 10, which act on the compression piston 9, are seated in the compression beam 1.

Installation of these spring elements 6 takes place with the aid of a hydraulic cylinder 11, which is advantageously guided in one or a plurality of guide bolts 12 of the compression beam 1. Either a shoulder 13 or the support surface 5 of the compression beam 1 is used as the upper abutment of the hydraulic cylinder 11. The required pre-compression force is applied to the compression cylinder 9 via a compression element 14 inserted through a bore 15 of the support surface 4 of the compression beam 1.

After fixing the disk springs 8 over the compression piston 9 which, in turn, is held by the adjustment screws 10, the hydraulic cylinder 11 and the compression element 14 can be removed. To make compression adjustment easier, the compression element 14 can be screwed together with the compression piston 9.

The arrangement of the disk springs 8 must be made in such a way that the compression force necessary for operational reliability is maintained even after possible settling actions of the winding 2. A check of the compression and possible compression adjustment are always possible and simply performed.

In FIG. 2 the installation of spring elements in a transformer is illustrated, where the system in accordance with FIG. 1 cannot be used, for example for lack of space. Installation of these spring elements could take place later, for example in the course of an inspection.

A requirement for this is that in the support surface 4 of the compression beam 1 either a support ring 16 is provided in the present bore 15—as shown—or possibly a threaded bore for the adjustment screws 17.

The windings 2 are pre-compressed to the calculated compression by means of hydraulic cylinders 11 which are inserted between the compression beam 1 and the winding compression ring 3. Subsequently the pre-compressed spring elements 6 are inserted.

Pre-compression of the spring elements 6 takes place via a stop 18, which limits the path of the compression piston 9 and thus the spring path of the disk springs 8 in the bushing 7. The adjustment screw 17 is placed on the compression piston 9 and pressure is removed from the hydraulic cylinders 11. The hydraulic cylinders can be removed. Tightening of the stop 18 is subsequently possible because of the exactly tuned design of the system.

The number of spring elements 6 to be employed per winding 2 depends in both cases on the required total compression force.

I claim:

1. A substation transformer, comprising:

a winding compression ring;

a winding closed off by said winding compression ring;

a compression beam having a first support surface that extends horizontally and a second support surface, said first support surface having a bore and being positioned at a lower portion of said compression beam, said second support surface being positioned at an upper portion of said compression beam;

expanding spring elements disposed concentrically around a core portion of said winding, said expanding spring elements being disposed between said compression beam and said winding compression ring, each of said spring elements comprising a spring, a bushing for receiving said spring, and a compression piston provided to close an open end of said bushing, said compression piston being adapted to limit a path of movement of said spring, said spring comprising disk springs;

post-installation modification apparatus comprising:

compression means for compressing said winding, said compression means comprising a hydraulic cylinder adapted to be removably inserted between said compression beam and said winding compression ring;

adjustment screw adapted to be adjusted within a threaded bore provided in said first support surface of said compression beam, and to act on said compression piston to thereby adjust compression of said disk springs; and a stop adapted to be removably included in said bushing to limit movement of said compression piston and thereby to hold said disk springs in a pre-stressed state.

2. The substation transformer according to claim 1, wherein said second support surface comprises a shoulder.

3. The substation transformer according to claim 1, wherein said threaded bore is formed by a support ring included in said bore.

4. The substation transformer according to claim 1, further comprising at least one guide bolt which extends vertically, and which is disposed on said first support surface.

5. A substation transformer comprising:

a winding compression ring;

a winding closed off by said winding compression ring;

a compression beam having a a lower support member, said lower support member having a bore;

expanding spring elements disposed between said compression beam and said winding compression ring; and post-installation modification apparatus comprising:

compression means for compressing said winding, said compression means comprising a hydraulic cylinder adapted to be removably inserted between said lower support member portion of said compression beam and said winding compression ring; and adjustment screws adapted to be adjusted within a threaded bore provided in said lower support member for adjusting compression of said expanding spring elements.

6. The substation transformer according to claim 5, wherein said hydraulic cylinder is inserted between said lower support portion of said compression beam and said winding ring.

7. The substation transformer according to claim 6, further comprising a stop provided near an open end of each of said spring elements to limit movement of a compression piston provided in each of said spring elements, thereby holding said spring elements in a pre-stressed state.

* * * * *